US005762832A

United States Patent [19]

Glew

[11] Patent Number: 5,762,832

[45] Date of Patent: Jun. 9, 1998

[54] IC ENGINE FUEL SUPPLY SYSTEM

[76] Inventor: Wayne Kenneth Glew, 3 Abelia Street, Rangeway, Geraldton 6530, Western Australia, Australia

[21] Appl. No.: 732,223

[22] PCT Filed: Apr. 21, 1995

[86] PCT No.: PCT/AU95/00239

§ 371 Date: Oct. 25, 1996

§ 102(e) Date: Oct. 25, 1996

[87] PCT Pub. No.: WO95/29335

PCT Pub. Date: Nov. 2, 1995

[30] Foreign Application Priority Data

Apr. 26, 1994 [AU] Australia ..... PM5244

[51] Int. Cl.[6] ..... F02M 9/133

[52] U.S. Cl. ..... 261/36.2; 261/64.4; 261/59; 261/96; 261/DIG. 21

[58] Field of Search ..... 261/64.4, 96, 59, 261/36.2, DIG. 21

[56] References Cited

U.S. PATENT DOCUMENTS

| | | | |
|---|---|---|---|
| 1,097,039 | 5/1914 | Miller | 261/96 |
| 1,103,178 | 7/1914 | Eiker | 261/59 |
| 1,324,515 | 12/1919 | Otti | 261/64.4 |
| 1,358,876 | 11/1920 | Richardson . | |
| 1,387,420 | 8/1921 | Lombard . | |
| 1,464,333 | 8/1923 | Pembroke . | |
| 2,026,798 | 1/1936 | Pogue . | |
| 2,194,540 | 3/1940 | Breeze | 261/64.4 |
| 3,336,734 | 8/1967 | Schultz | 261/96 |
| 3,892,547 | 7/1975 | Tucker | 261/96 |
| 4,123,233 | 10/1978 | Mannino | 261/64.4 |
| 4,372,275 | 2/1983 | Schmidt | 261/96 |

FOREIGN PATENT DOCUMENTS

| | | |
|---|---|---|
| 499757 | 11/1975 | Australia . |

*Primary Examiner*—Tim R. Miles

[57] ABSTRACT

An IC engine fuel supply system (10) having a vaporization chamber (30) which has a foam mantle (48) for suspending fuel in a flow of air from a venturi inlet (72) for vaporizing the fuel. The vaporized fuel is mixed with the air in a mixing chamber (32) and then conveyed to an intake manifold of an IC engine. The system (10) improves the efficiency of the combustion of the fuel and reduces the amount of pollution produced.

8 Claims, 3 Drawing Sheets

IC ENGINE FUEL SUPPLY SYSTEM

This application is a 371 of PCT/AU95/00239 Apr. 21, 1995.

FIELD OF THE INVENTION

The present invention relates to an IC engine fuel supply system having a vapourising/pollution reducing carburettor particularly, although not exclusively, envisaged for use in the supply of liquid fuels into internal combustion (IC) engines in a vaporized form for reducing the quality of liquid fuel required for a given amount of energy output from the IC engine and for reducing the quantity of pollution produced by the IC engine in producing that energy.

BACKGROUND OF THE INVENTION

In the field of IC engines is it known to use carburettors to meter liquid fuel into the IC engine for combustion in a combustion chamber. The carburettor causes a mixing of the liquid fuel with air for said combustion.

Prior art carburettors have focussed on the issue of the nature of the mixture of the liquid fuel with the air, for example as shown in U.S. Pat. Nos. 1,358,876 (Richardson), 1,387,420 (Lombard) and 1,464,333 (Pembroke).

The actual explosion of the fuel/air mixture in the combustion chamber does not occur until the fuel vaporises. This vapourisation is achieved by the residual heat of the combustion chamber and the pressure of the compression stroke of the piston in the cylinder of the engine corresponding to the combustion chamber. As a result of this there is a delay between ignition of the fuel/air mixture and actual explosion to drive the piston down in the cylinder. Accordingly, the ignition of the fuel/air mixture must be initiated before the compression stroke of the piston is complete. Typically, the ignition occurs at between 6° to 10° before the piston reaches "top dead centre" (which signifies completion of the compression stroke). During the time after ignition and prior to explosion the liquid fuel is gradually vapourised as a flame front from a spark plug travels through the combustion chamber. When sufficient of the liquid fuel has vapourised the fuel/air mixture reaches an accelerated rate of combustion known as an explosion. The timing of the ignition is set so that the explosion occurs when the piston has reached top dead centre and hence maximum down force is imparted to the piston and hence is applied to the motive force of the IC engine.

However, a disadvantage of this is that some of the fuel in the combustion chamber remains in a liquid state even through the explosion and is subsequently exhausted to the atmosphere. This leads to a reduction in the efficiency of the use of the fuel and an increase in the pollution created by the IC engine.

The efficiency of the use of the fuel can be increased by vapourising the fuel before it enters into the combustion chamber. Then all of the vapourised fuel can be exploded and be applied to the motive force of the IC engine. Also, as a consequence of the more complete burn there is less pollution produced.

Attempts have been made in the past to vaporise the fuel prior to its entry into the carburettor by heating the fuel with heated gases from the IC engine exhaust, as exemplified by POGUE in U.S. Pat. No. 2,026,798. A disadvantage of these types of systems is that they are relatively complex, and difficult and expensive to manufacture.

My invention concerns how to achieve vapourisation prior to introduction into the combustion chamber without the use of heat.

SUMMARY OF THE INVENTION

Therefore it is an object of the present invention to provide an IC engine fuel supply system having a vapourising/pollution reducing carburettor for vapourising fuel prior to its entry into the IC engine.

In accordance with one aspect of the present invention there is provided an IC engine fuel supply system having a vapourising/pollution reducing carburettor for an IC engine, the vapourising/pollution reducing carburettor comprising:

- a vapourisation chamber having a mantle means for suspending fuel within the vapourisation chamber, and a mesh means associated with the mantle means such that the fuel must flow through the mesh means when leaving the mantle means;
- a fuel intake means located in operative association with the vapourisation chamber for metering an amount of the fuel from a fuel supply to the mantle means for suspension in the vapourisation chamber;
- an air intake means located upstream of the vapourisation chamber, the air intake means having a valve means for regulating the amount of air flowing through the vapourisation chamber in accordance with the pressure in an intake manifold of the IC engine, the air intake means being disposed so that air is directed through the mantle means for vapourising said fuel suspended in the said mantle means;
- a fuel scavenger means in operative association with the mantle means for removing excess and non-vapourised fuel from the mantle means and from the vapourisation means and returning said fuel to the fuel supply; and,
- a conduit means for introducing vapours from the vapourisation chamber into an intake manifold of the IC engine.

BRIEF DESCRIPTION OF THE DRAWINGS

An exemplary embodiment of the present invention will now be described with reference to the accompanying drawings in which.

DETAILED DESCRIPTION OF THE PREFERRED EMBODIMENT(S)

Figure 1:
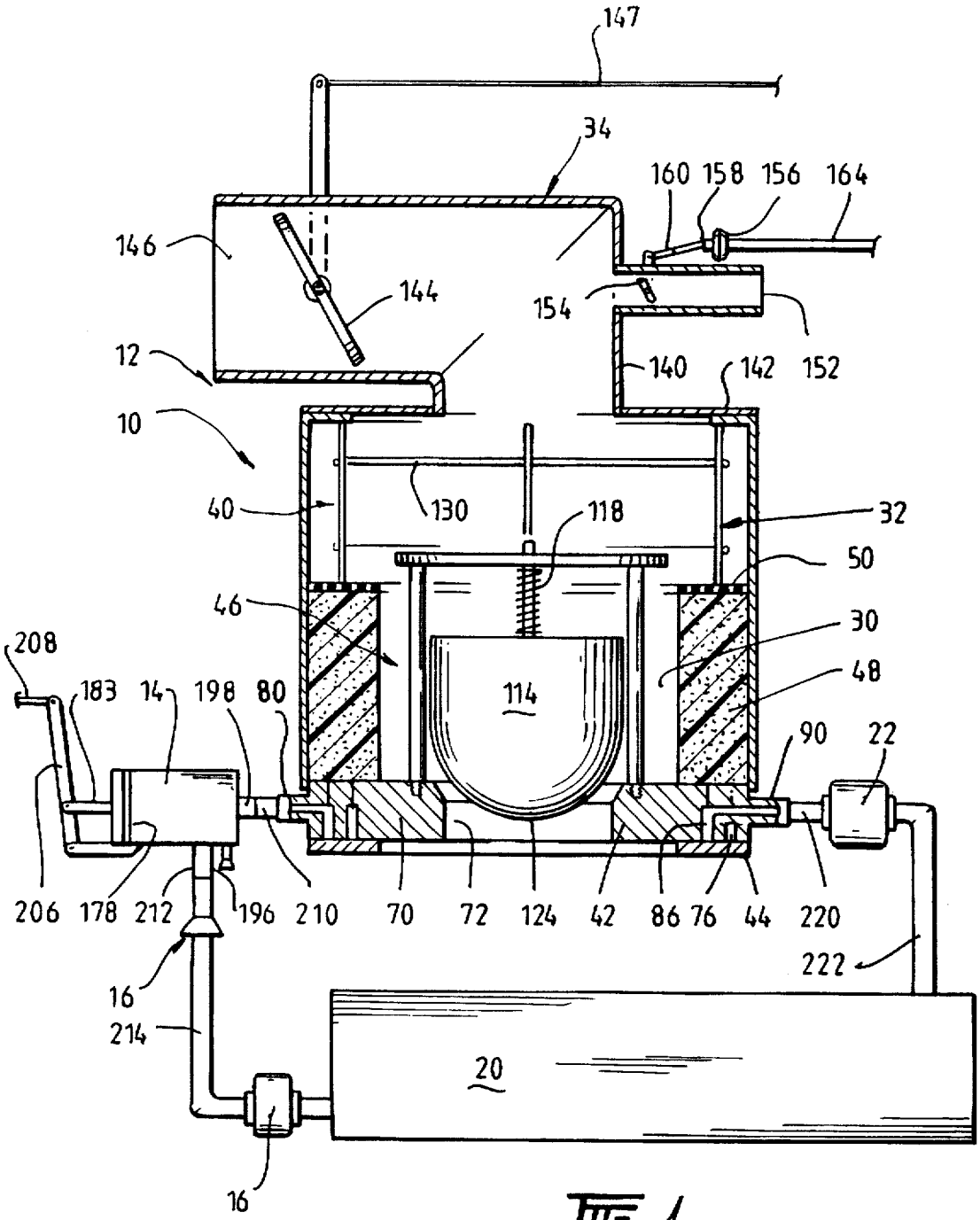
FIG. 1 is a schematic representation of an IC engine fuel supply system incorporating a vapourising/pollution reducing carburettor both in accordance with the present invention.

In FIG. 1 there is shown an IC engine fuel supply system 10 comprising a carburettor 12, a fuel supply valve 14, a pressure reduction valve 16, fuel pump 18, a fuel tank 20 and a scavenger pump 22 for use in association with an IC engine. The fuel supply valve 14 connects the carburettor 12 to the fuel tank 20 via the pressure reduction valve 16, and the scavenger pump 22 provides return path for unused fuel from the carburettor 12 back to the fuel tank 20.

The carburettor 12 comprises a vapourisation chamber 30, a mixing chamber 32 and a vapour outlet chamber 34. The vapourisation chamber 30 is in part defined within a canister 40. The vapourisation chamber 30 comprises a valve base plate 42, sealing plate 44, a ball valve 46, a foam mantle 48 and a perforated annular washer 50. The valve base plate 42 sits upon the sealing plate 44 which is attached to an air intake conduit (not shown—as are commonly used in present day motor cars). The ball valve 46 seals upon the valve base plate 42 and is housed inside the foam mantle 48. Whilst, the perforated annular washer 50 sits upon the foam mantle 48.

Figures 2A, 2B, 2C, 2D, 2E:
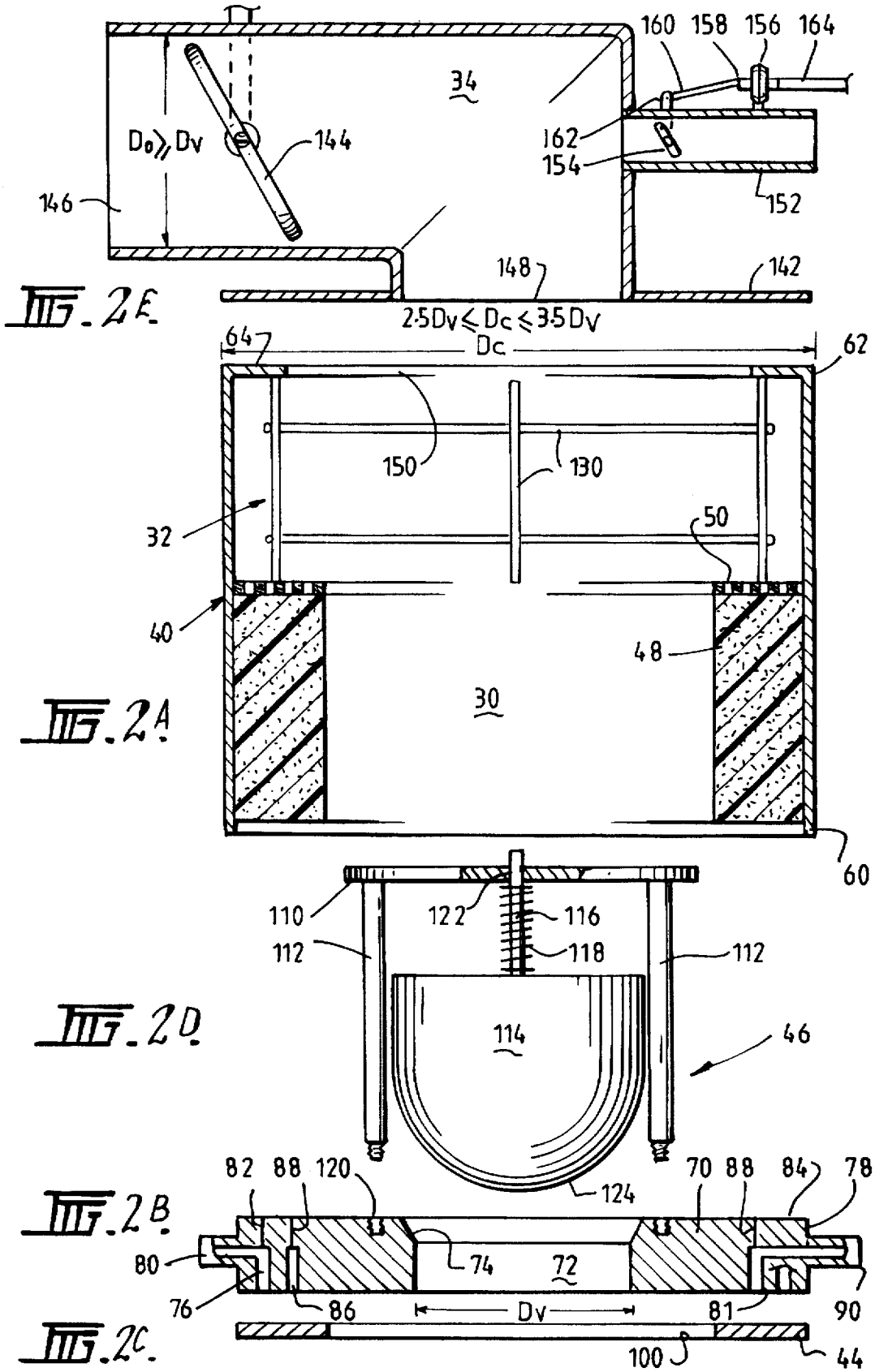
FIG. 2A is cross-sectional side view of a canister of the carburettor of FIG. 1 and including a vapourisation chamber and a mixing chamber.
FIG. 2B is a cross-sectional side view of a valve base plate of the carburettor of FIG. 1.
FIG. 2C is a cross-sectional side view of sealing plate of the carburettor of FIG. 1.
FIG. 2D is a cross-sectional side view of a valve of the carburettor of FIG. 1.
FIG. 2E is a cross-sectional side view of vapour outlet chamber of the carburettor of FIG. 1.
Figure 3A:
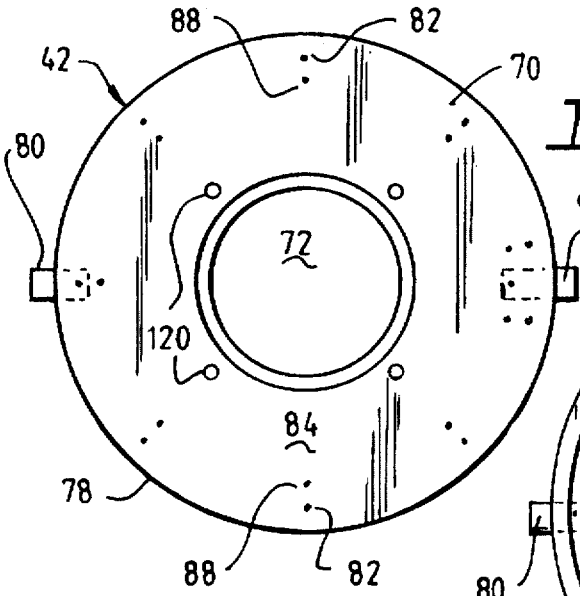
FIGS. 3A and 3B are respectively an upper plan view and a lower plan view of the valve base plate of FIG. 2B.
Figure 3B:
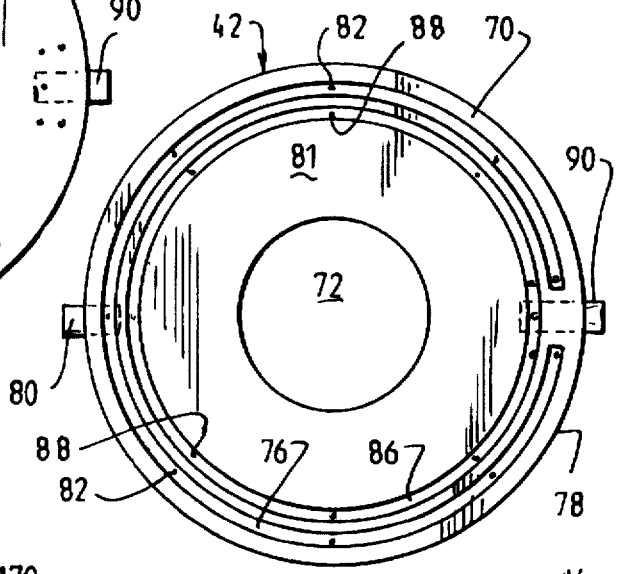

As shown in more detail in FIG. 2A the canister 40 is substantially cylindrical and has an lower end 60 and an upper end 62 provided with an inwardly disposed annular lip 64 for attachment to the vapour outlet chamber 34. A lower portion of the canister 40 defines a part of the vapourisation chamber 30.

As shown in FIG. 2B the valve base plate 42 is generally circular when viewed in plan and substantially rectangular when viewed one its side. The base plate 42 has a body 70 with a central venturi inlet 72 which has a valve seat 74 in its upper edge. The valve seat 74 is disposed to receive the ball valve 46. The valve seat 74 is typically at an angle of 45° to the axis of the venturi inlet 72 so as to direct air out of the venturi inlet 72 at an angle of about 45° and hence into the foam mantle 48 as described in more detail hereinafter.

The valve base plate 42 also has a first annular channel 76 extending substantially entirely about the body 70 proximate its outer edge 78. The first annular channel 76 is in fluidic communication with a fuel inlet 80 located in the outer edge 78 of the body. Also, the first annular channel 76 opens into a lower face 81 of the body 70 and has a plurality of relatively small holes 82 connecting it to an upper face 84 of the body 70 so that fluid can flow from the fuel inlet 80, around the first channel 76 and through the holes 82 to the upper face 84 and hence to the foam mantle 48.

The valve base plate 42 also has a second annular channel 86 which is substantially coaxial with the first annular channel 76 and located between the first annular channel 76 and the venturi inlet 72. The second annular channel 86 also opens into the lower face 81 and has relatively small holes 88 connecting it to the upper face 84. The body 70 also has a fuel outlet 90 located in the outer edge 78 of the body 70 typically opposite from the fuel inlet 80. The second annular channel 86 is in fluidic communication with the fuel outlet 90 so that fuel can flow from the upper face 84, through the holes 88, into the second annular channel 86 and to the fuel outlet 90.

The holes 82 have a diameter of between 1 mm and 3 mm depending upon the fuel requirements of the IC engine. For example, a 4 liter IC engine typically requires holes with a diameter of about 2 mm. Preferably, the diameter of the holes 82 is greater than the mesh size of a fuel filter of the IC engine so that any detritus material which is not caught by the fuel filter will not block the holes 82.

The holes 88 have a diameter which is greater than the holes 82 so that the excess fuel can be easily scavenged back to the fuel tank 20. The diameter of the holes 88 is typically between 2 mm and 5 mm, such as, for example, about 3 mm in the case of a 4 liter IC engine.

As shown in FIG. 2C the sealing plate 44 is circular when viewed in plan and substantially rectangular when viewed from the side. The sealing plate 44 has a diameter which is substantially the same as that of the body 70 of the valve base plate 42. The sealing plate 44 has a central hole 100 which is intended to be coaxial with the venturi inlet 72 of the valve base plate 42. The hole 100 is intended to be larger than the venturi inlet 72 so as to not affect the flow of air into the venturi inlet 72. The sealing plate 44 is fixed to the lower face 81 of the valve base plate 42 so as to close off the first and second channels 76 and 86 to form two annular conduits with the valve base plate 42. Typically, the sealing plate 44 is attached to an air duct for conveying a stream of air into the carburettor 12.

As shown in FIG. 2D the ball valve 46 comprises a top plate 110, a plurality of posts 112 (such as 4 posts 112), a valve member 114, a guide rod 116 and a compression spring 118. The posts 112 are threadedly engaged with threaded mounting holes 120 in the upper face 84 of the valve base plate 42 at one end and secured to the top plate 110 at their other end. The guide rod 116 is located in a hole 122 in the top plate 110 so as to allow the valve member 114 to rise and fall with respect to the top plate against the downward force of the spring 118 which is located about the guide rod 116 between the top plate 110 and the valve member 114. The force of the spring 118 is large enough to cause the valve member 114 to seat against the valve seat 74 and to allow the valve member 114 to rise up off the valve seat 74 to introduce air into the carburettor when low pressure is induced in the carburettor by the intake stroke of the IC engine. The valve member 114 has a head 124 which is shaped to seat against the valve seat 74. For this purpose the head 124 is typically hemispherical. The top plate 110 is typically square when viewed in plan and is dimensioned to fit within the foam mantle 48 so that air passing through the venturi inlet 72 tends to flow through the foam mantle 48. The foam mantle 48 and the ball valve 46 define the vapourisation chamber 30.

As shown in FIG. 2A the foam mantle 48 is located within the lower reaches of the canister 40 with the perforated annular washer seated on top of it. The foam mantle 48 is in the shape of an annular ring. The foam mantle 48 is made from foamed plastics materials which have a reticulated (open pore) structure which is porous to liquids and allows liquids to flow through it whilst retaining a fine film of the liquid suspended in it. For example, the foamed plastics material could be a reticulated polyurethane foamed plastic such as sold under the registered Trade Mark MERACELL. The lower end 60 of the canister 40 is secured to the valve base plate 42 with the foam mantle 48 firmly in contiguous contact with the upper face 84 of the valve base plate 42 over the holes 82 and 88.

A wire cage 130 is located between the lip 64 and the perforated annular washer 50 for defining the mixing chamber 32. Typically, the cage 130 is made from aluminium, although other metals or even plastics materials could be used provided they are resistant to attack by hydrocarbon fuels and do not react with other materials in the carburettor 12. The perforated annular washer 50 typically has a 50% perforation rate. That is the perforated annular washer 50 is 50% holes by area and 50% solid material by area in the region of its annulus. Typically, the holes have a diameter of between 0.5 mm and 2.0 mm, such as, for example, about 1.0 mm.

The canister 40 has a height which varies according to the capacity of the IC engine which it is used with. Typically, for a 2 liter engine the canister 40 has a height of about 150 mm.

The height of the vapourisation chamber 30 is the canister 40 is to kept relatively constant at about 100 mm and the height of the mixing chamber 32 is varied for IC engines of differing capacities. Hence, in relation to the 2 liter IC engine the mixing chamber 32 has a height of about 50 mm (and the canister 40 a height of about 150 mm). In the event that the height is less than this complete vapourisation of fuel is not achieved. In the event that the height is more than this the extra capacity of the mixing chamber is not detrimental to the vapourisation of the fuel. For an IC engine with a capacity of about 6 liters it is intended that the canister 40 have a height of about 200 mm. In relation to relatively small capacity IC engines, such as in motor cycles, it is envisaged that the canister 40 have an overall height of about 120 mm and in relation to relatively large IC engines, such as in trucks, it is envisaged that the canister 40 have a diameter of about 240 mm. It is intended that the canister by mounted onto the fire wall of the engine bay of a motor vehicle. This is considered necessary since the canister 40 alone is higher and wider than most conventional carburettors.

The diameter of the canister 40 is dictated by the diameter of the venturi inlet 72, which is in turn dictated by the capacity of the IC engine. In relation to the 2 liter IC engine example the venturi inlet 72 is about 49 mm. This is the value determined by the manufacturer of the IC engine for the venturi size in its engine. The diameter of the canister 40 is preferably between 2.5 and 3.5 times the diameter of the venturi inlet 72. Hence, for the 2 liter IC engine example the canister 40 preferably has a diameter of between about 120 mm and 170 mm. If the diameter of the canister 40 is less than 2.5 time the diameter of the venturi inlet 72 then the carburettor 12 will draw too much fuel for the amount of air flowing through the venturi inlet 72. And if the diameter of the canister 40 is greater than 3.5 times the diameter of the venturi inlet 72 then the IC engine will experience fuel starvation and a loss in throttle response since insufficient fuel will flow for the amount of air flowing through the venturi inlet 72.

As shown in FIG. 2E the vapour outlet chamber 34 is defined by an elbow shaped duct 140 which has a flange 142 for fixture to the lip 64 of the canister 40. The duct 140 has a butterfly valve 144 located proximate its mouth 146. The butterfly valve 144 is controlled by an accelerator cable 147. The vapour outlet chamber 34 has an inlet 148 which overlies a hole 150 in the upper end 62 of he canister 40. The vapour outlet chamber 34, from its inlet 148 to the mouth 146, has a diameter which is greater the diameter of the venturi inlet 72. This is required so that the vapour outlet chamber 34 does not cause a restriction in the flow of the air from the venturi inlet 72 to the mouth 146. The mouth 146 is typically connected to the inlet manifold of the IC engine by a flexible conduit.

The vapour outlet chamber 34 also has a supplementary air intake 152 with a butterfly valve 154 controlled by a vacuum unit 156 connected via a control rod 158 and a link 160 to a lever arm 162 attached to a pivot of the butterfly valve 154. The vacuum unit 156 is connected to the intake manifold of the IC engine (in much the same way as an ignition timing advance for a conventional carburettor system) by a vacuum line 164 so that in the event that the vacuum in the intake manifold becomes sufficiently large the butterfly valve 154 starts to open to allow more air into the carburettor so as to allow the IC engine to breathe better when under load.

Figure 4A:
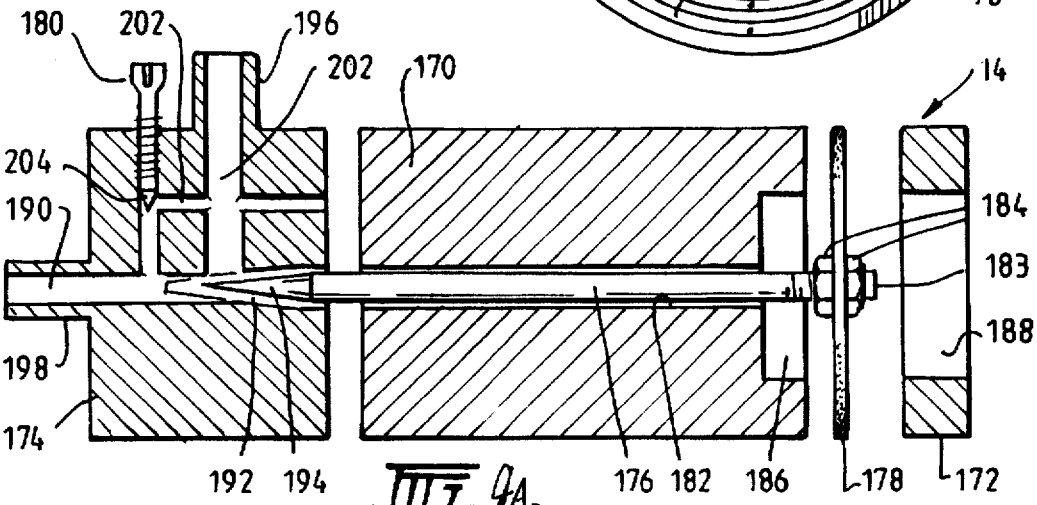
FIGS. 4A to 4C are respectively an exploded cross-sectional side view, a front end view and a rear end view of a fuel supply valve of the IC engine fuel supply system of FIG. 1.
Figure 4B:
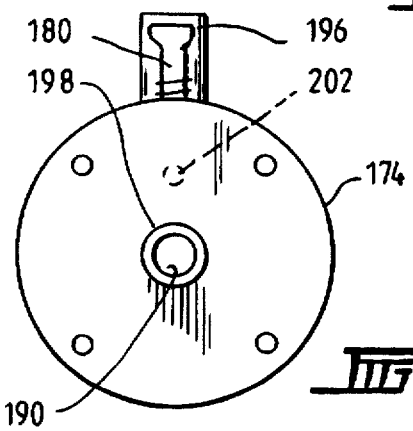
Figure 4C:
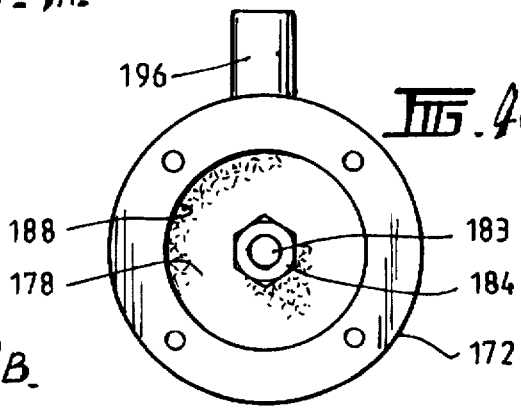

As shown in FIGS. 4A to 4C the fuel supply valve 14 has a body 170, an end cap 172, a head 174, an accelerator jet 176, a diaphragm 178 and an idle jet 180. The body 170 has a central hole 182 which receives the accelerator jet 176. The diaphragm 178 is sandwiched between the body 170 and the end cap 172 and is attached to a threaded end 183 of the accelerator jet 176 by nuts 184. One end of the hole 182 terminates in a recess 186 which is dimensioned to allow movement of the assembly of the accelerator jet 176, the diaphragm 178 and the nuts 184 in it as the accelerator jet 176 moves axially in the hole 182. The end cap 172 has an aperture 188 also for allowing the said movement of the said assembly.

The head 174 has a conduit 190 extending through it and with a jet seat 192 intermediate of its length. The valve seat 192 is shaped to receive a pointed end 194 of the accelerator jet 176. The head 174 also has a fuel inlet 196 and a fuel outlet 198. The fuel inlet 196 is connected to the conduit 190 by a conduit 200 upstream of the valve seat 192 so that the pointed end 194 of the accelerator jet 176 can interrupt the flow of fuel from the fuel inlet 196 to the fuel outlet 198. The fuel outlet 198 is in fluidic communication with the conduit 190 downstream of the jet seat 192. The head 174 also has a bleed conduit 202 connected from the conduit 200 to the fuel outlet 198. The bleed conduit 202 has a head 204 of the idle jet 180 located in it so that the idle jet 180 can adjust the rate of flow of fuel along the bleed conduit 202 when the accelerator jet 176 is seated against the jet seat 192.

As shown in FIG. 1 a throttle lever 206 pivotably attached to the threaded end 183 of the accelerator jet 176 and to the end cap 172. The throttle lever 206 is attached to a throttle cable 208 so that pulling of the throttle cable gives a proportionate (but smaller) movement of the accelerator jet 176.

Also, as shown in FIG. 1 the fuel outlet 198 is connected by a hose 210 to the fuel inlet 80 of the valve base plate 42. Another hose 212 connects the fuel inlet 196 to the low pressure side of the pressure reduction valve 16. The high pressure side of the pressure reduction valve 16 is connected to the fuel pump by a hose 214 and hence to the fuel tank 20. Typically, the pressure reduction valve 16 reduces the pressure of fuel from the fuel pump 18 to between 14 kPa to 36 kPa, such as about 24 kPa. The pressure reduction depends upon the typical load which the IC engine experiences.

The fuel outlet 90 of the valve base plate 42 is connected by a hose 220 to the scavenger pump 22. A further hose 222 connects the scavenger pump 22 to the fuel tank 20 so that fuel scavenged from the carburettor 12 can be returned to the fuel tank 20 for later use. The scavenger pump 22 typically operates at a pressure of about 90 kPa, although this is not critical provided that it exceeds the pressure of the fuel at the downstream end of the pressure reduction valve 14.

In use, the canister 40 carburettor 12 is attached to the fire wall of the engine bay of a vehicle. The pressure reduction valve 16 is attached to the hose 214 from the fuel pump 18, the hose 222 is connected from the scavenger pump 22 to the fuel tank 20, the mouth of the vapour outlet chamber 34 is connected by a conduit to the intake manifold of the IC engine, the accelerator cable 147 is connected to the butterfly valve 144, the vacuum line is connected to the vacuum unit 156 and the throttle cable 208 is connected to the throttle lever 206.

When the IC engine is at idle fuel flows from the fuel tank 20 by force of the fuel pump 18, through the pressure reduction valve 16 to the fuel supply valve 14. The fuel enters the fuel inlet 196 of the fuel supply valve 14, flows along the bleed conduit 202 past the idle jet 180 and to the fuel outlet 198. The rate of flow of the fuel during idle is set by the position of the idle jet 180 in its threaded engagement with the head 174 of the fuel supply valve 14.

During non-idle operation of the IC engine the throttle cable 208 is pulled to pivot the throttle lever 206 and hence relieve the accelerator jet 176 from the jet seat 192. This allows fuel to flow along the conduit 200, past the jet seat 192 and to the fuel outlet 198. The rate of flow of fuel through the fuel supply valve 14 now depends upon the angular position of the throttle lever 206 and hence the amount that the pointed head 194 of the accelerator jet 176 is displaced from the jet seat 192.

In both of the above cases the fuel flows from the fuel outlet 198 along the hose to the fuel inlet 80 of the valve base plate 42. There the fuel enters the first channel 76 and flows about it, filling the channel 76 and rising up the holes 82 to the foam mantle 48. By virtue of the porosity of the foam mantle 48 the fuel is absorbed into the foam mantle 48.

The vacuum created in the intake manifold of the IC engine causes a low pressure region to develop in the vapourisation chamber 30 about the valve member 114. This causes the valve member 114 to be drawn upwardly against the returning force of the spring 118. Consequently air is drawn in through the venturi inlet 72. By virtue of the angle of the valve seat 74 and the position of the valve member 114 the air enters the vapourisation chamber 30 at an angle of about 45° to the axis of the chamber 30 and enters into the foam mantle 48. The air is drawn, by the low pressure in the intake manifold, up through the foam mantle 48 and out of the perforated annular washer 50. As the air is drawn up through the foam mantle 48 the fuel suspended in the porous cells of the foam mantle 48 are bombarded with the air particles which causes the fuel to become a vapour.

The vapour leaves the vapourisation chamber 30 through the perforations in the washer 50 and through a centre of the washer about the top plate 110 of the ball valve 46. The vapourised fuel and the air mix in the mixing chamber 32 and under the influence of the lower pressure are drawn into the vapour outlet chamber 34. The amount of influence which the lower pressure in the intake manifold has on the flow of air through the carburettor 12 depends in part on the angular position of the butterfly valve 144 in the mouth 146 of the vapour outlet chamber 34 so that as the angle increases more vapourised fuel mixed in air is drawn through the carburettor 12.

In the event that the low pressure in the intake manifold continues to rise (indicating a large load on the IC engine) the vacuum unit 156 operates to pivot the butterfly valve 154 to allow more air into the vapour outlet chamber 34 from the supplementary air intake 152.

When the demand for fuel reduces excess fuel is drawn back down onto the upper face 84 of the valve base plate 42 by the scavenger pump 22 creating a lower pressure region in the second channel 86 and hence in the holes 88. The fuel so scavenged is pumped by the scavenger pump 22 back to the fuel tank 20 for later use.

I have discovered that in the exemplary embodiment the angle of the valve seat 74 for the ball valve 46 is quite critical to the efficiency with the fuel is vapourised. That is the angle of the valve seat 74 must be about 45°. However, if the fuel is injected downwardly (by an injection plate in the form of the valve base plate 42 without the second channel 86) into the foam mantle 48 at its upper end and the fuel is scavenged at the lower end of the foam mantle 48 then the angle need not be 45°. In this situation the angle of the valve seat 74 is no longer of special significance. This occurs since in this situation the injection plate controls the updraught of fuel through the foam mantle 48.

I have discovered that applying the IC engine fuel system 10 of the present invention to an old model 6 cylinder motor car reduces its fuel consumption from about 13 liters/100 kms (20 miles per gallon) to about 2.6 liters/100 kms (110 miles per gallon). Simultaneously, since there is a much more complete burn of the fuel there is a great reduction in the pollution produced.

I have also discovered that since the fuel reaches the IC engine already vapourised (and vapourisation does not have to occur during the combustion process) the timing of the ignition of the IC engine can be changes from between 6° to 10° before top dead centre to about 0.5° before top dead centre.

The IC engine fuel supply system 10 of the present invention has the advantage that it provides easy and efficient vapourisation of fuel, the result of which is a vast improvement in fuel efficiency and a considerable reduction in pollution. Hence, conventional anti-pollution equipment used on present day cars can be omitted, thus saving on the cost of the vehicle. Also, by the use of the scavenger second channel 86 and the scavenger pump excess fuel is returned for reuse which improves the efficiency of the system 10. Further, since less fuel is used there is less wear in the engine and the engine operates at a lower temperature. Effectively, the system converts a 4 stroke engine into a 3 stroke engine since the timing of the engine can be much reduced. Still further, the system 10 increase the throttle response of the IC engine.

Modifications and variations such as would be apparent to a skill addressee are considered within the scope of the present invention.

I claim:

1. An IC engine fuel supply system having a vaporizing/pollution reducing carburetor for an IC engine, the vaporizing/pollution reducing carburetor comprising:

a vaporization chamber having a mantle means for suspending fuel within the vaporization chamber, and a perforated annular washer located above the mantle means so that the fuel must flow through the perforated annular washer when leaving the mantle means;

a fuel intake means located in operative association with the vaporization chamber for metering an amount of the fuel from a fuel supply to the mantle means for suspension in the vaporization chamber;

an air intake means located upstream of the vaporization chamber, the air intake means having a valve means for regulating the amount of air flowing through the vaporization chamber in accordance with the pressure in an intake manifold of the IC engine, the air intake means being disposed so that air is directed through the mantle means for vaporizing said fuel suspended in the said mantle means;

a fuel scavenger means in operative association with the mantle means for removing excess and non-vaporized fuel from the mantle means and from the vaporization means and returning said fuel to the fuel supply; and, a conduit means for introducing vapors from the vaporization chamber into an intake manifold of the IC engine.

2. An IC engine fuel supply system according to claim 1, in which the mantle means is a reticulated foamed plastics material which suspends the fuel throughout its volume.

3. An IC engine fuel supply system according to claim 1, in which the perforated annular washer has perforations which occupy about 50% of the area of the annulus of the washer so that the air can force the vaporized fuel through the washer.

4. An IC engine fuel supply system according to claim 1, also having a mixing chamber downstream of the vaporization chamber for mixing the vaporized fuel with the air from the intake means.

5. An IC engine fuel supply system according to claim 4, in which the vaporization chamber has a height of about 100 mm and the mixing chamber has a height of greater than about 50 mm, and the vaporization chamber and the mixing chamber have a diameter which is between 2.5 and 3.5 times the diameter of a venturi inlet of the air intake means so as to draw the fuel out of the fuel intake means into the mantle means.

6. An IC engine fuel supply system according to claim 1, in which the said fuel intake means has a first channel in fluidic communication with the fuel supply and a plurality of holes leading from the first channel to the mantle means for allowing a flow of the fuel to be produced from the fuel supply to the mantle means, and the fuel scavenger means having a scavenger pump in fluidic communication with the fuel supply and a second channel having a plurality of holes leading from the mantle means into the channel so that a flow of fuel can be induced by said scavenger pump from the mantle means back to the fuel supply to remove excess fuel from the vaporization chamber.

7. An IC engine fuel supply system according to claim 1, in which the air intake means has a ball valve which is movable under the action of the force of a draught created by the pressure in the intake manifold so that air passes through the mantle means for vaporizing the fuel.

8. An IC engine fuel supply system according to claim 7, in which the air intake means has a valve seat oriented at an angle of about 45° to the axis of the vaporization chamber, the valve seat providing a sealing surface for the ball valve when there is insufficient pressure in the intake manifold to move the ball valve from the valve seat and to cause a flow of air into the mantle means when the ball valve is moved from the valve seat.

* * * * *